US005201165A

United States Patent [19]

Marano et al.

[11] Patent Number: 5,201,165

[45] Date of Patent: * Apr. 13, 1993

[54] GAS DISPLACEMENT DEVICE FOR PACKAGING FOOD AND NON-FOOD PRODUCTS

[75] Inventors: Gerald A. Marano; Donald Evans, both of Mobile; Edwin D. Lomax, Satsuma; James C. Harbison, Fairhope, all of Ala.

[73] Assignee: International Paper Company, Purchase, N.Y.

[ * ] Notice: The portion of the term of this patent subsequent to Feb. 4, 2009 has been disclaimed.

[21] Appl. No.: 760,428

[22] Filed: Sep. 16, 1991

Related U.S. Application Data

[63] Continuation of Ser. No. 593,187, Oct. 5, 1990, Pat. No. 5,085,035.

[51] Int. Cl.[5] ..... B65B 31/04

[52] U.S. Cl. ..... 53/510; 53/432

[58] Field of Search ..... 53/403, 425, 426, 432, 53/510, 88, 89, 92, 110; 141/64

[56] References Cited

U.S. PATENT DOCUMENTS

| | | | |
|---|---|---|---|
| 2,362,799 | 11/1944 | Boyd et al. | 226/68 |
| 2,604,247 | 7/1952 | Andre | 226/68 |
| 2,623,672 | 12/1952 | O'Neil | 226/69 |
| 2,628,757 | 2/1953 | Brown et al. | 226/82 |
| 2,630,957 | 3/1953 | Hohl et al. | 226/82 |
| 2,693,305 | 11/1954 | Boyd et al. | 226/68 |
| 2,854,039 | 9/1958 | Boyd et al. | 141/70 |
| 2,869,301 | 11/1959 | Stover | 53/110 |
| 2,931,147 | 4/1960 | Barnby | 53/22 |
| 3,406,079 | 10/1968 | Gibble | 99/171 |
| 3,486,295 | 12/1969 | Rausing et al. | 53/89 |
| 3,545,160 | 12/1970 | Jantze et al. | 53/7 |
| 3,556,174 | 1/1971 | Gibble et al. | 141/69 |
| 3,664,086 | 5/1972 | James et al. | 53/112 A |
| 3,789,888 | 2/1974 | James et al. | 141/4 |
| 3,942,301 | 3/1976 | Domke | 53/110 |
| 3,946,534 | 3/1976 | Egly | 53/22 R |
| 4,140,159 | 2/1979 | Domke | 141/129 |
| 4,588,000 | 5/1986 | Malin et al. | 141/1 |
| 4,602,473 | 7/1986 | Hayashi et al. | 53/510 |
| 4,805,768 | 2/1989 | Nishiguchi et al. | 206/213.1 |
| 4,827,696 | 5/1989 | Arends et al. | 53/432 |
| 4,848,419 | 7/1989 | Damen | 141/61 |
| 4,869,047 | 9/1989 | Nishiguchi et al. | 53/432 |
| 4,870,801 | 10/1989 | Mizandjian et al. | 53/432 |
| 4,977,723 | 12/1990 | Dubrulle et al. | 53/110 |
| 5,085,035 | 2/1992 | Marano | 53/432 |

FOREIGN PATENT DOCUMENTS

| | | | |
|---|---|---|---|
| 551271 | 2/1942 | United Kingdom | 53/10 |

*Primary Examiner*—John Sipos

*Attorney, Agent, or Firm*—Ostrager, Chong & Flaherty

[57] ABSTRACT

A gas displacement device and method for substituting inert gas for ambient air in a gable-top paperboard carton prior to closing of an open top of the carton. The open top has first and second predetermined dimensions in mutually perpendicular directions. The device includes a source of inert gas, a channel for outputting a blanket of inert gas through an outlet and a conveyor for moving cartons in the first direction so that each open top passes under the outlet. The outlet has maximum dimensions in first and second mutually perpendicular directions which are respectively greater than the first predetermined dimension and less than the second predetermined dimension. The open top of the carton passes underneath the outlet with the directions of the first and second predetermined dimensions being oriented substantially parallel to the first and second directions respectively. The outlet has the shape of a rectangle with rounded corners. The length in the first direction of the portion of the outlet which overlies the open top varies continuously from zero to the first predetermined dimension, is constant and equal to the first predetermined dimension, and varies continuously from the first predetermined dimension to zero respectively during first, second and third portions of the passage of the carton underneath the outlet. The width in the second direction of the portion of the outlet which overlies the open top is constant and equal to the width of the rectangle during the second portion of the passage of the container underneath the outlet.

6 Claims, 5 Drawing Sheets

FIG 2
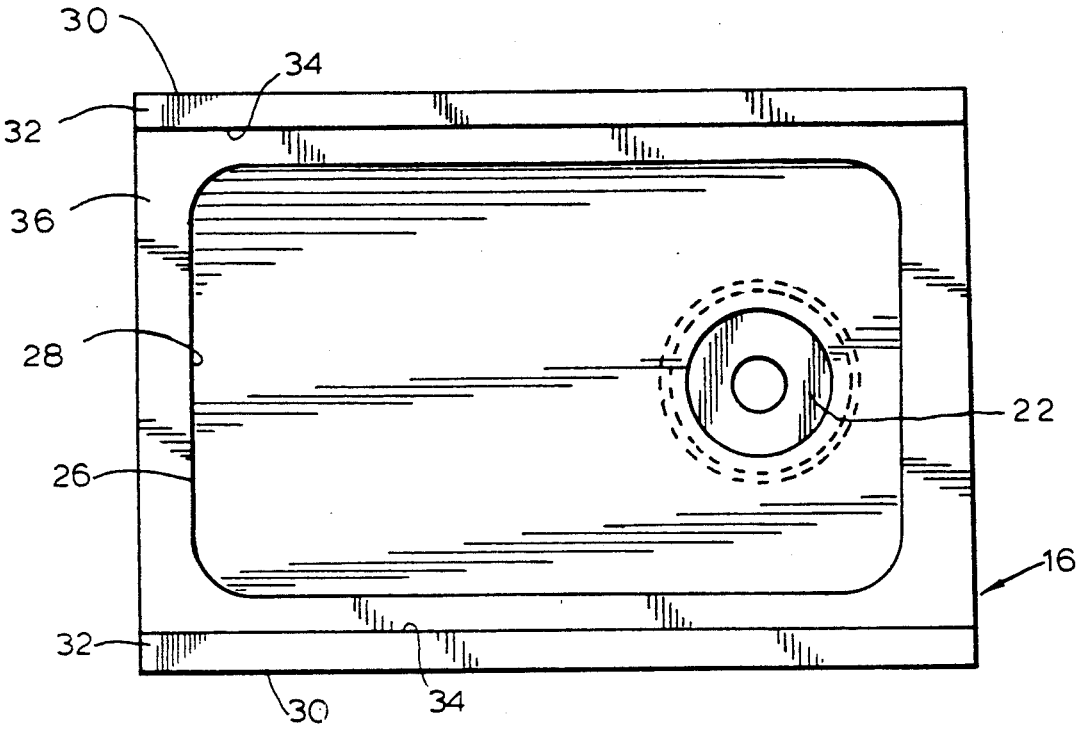
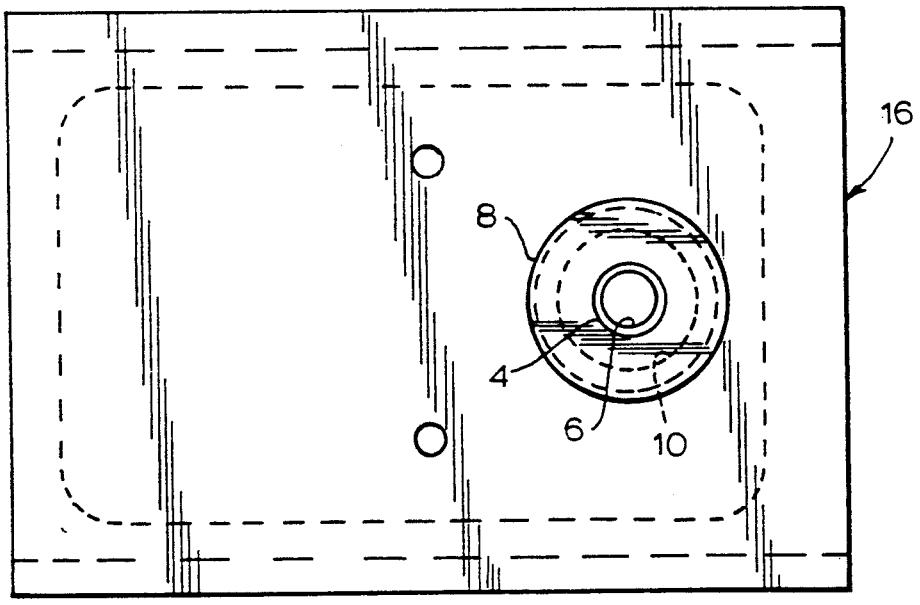
FIG. 3

GAS DISPLACEMENT DEVICE FOR PACKAGING FOOD AND NON-FOOD PRODUCTS

This is a continuation of co-pending application Ser. No. 07/593,187, filed on Oct. 5, 1990 now U.S. Pat. No. 5,085,035.

FIELD OF INVENTION

This invention generally relates to an apparatus and a method for removing oxygen from the headspace of a container filled with solid or liquid material. In particular, it relates to a device and method for substituting an inert gas for atmospheric air in the headspace of gable-top paperboard cartons.

BACKGROUND ART

In general, foods, medicines, cosmetics and other substances packaged in containers are oxidized by ambient air, resulting in degradation of the quality of the substance. In the prior art it is well known to remove oxygen from the headspace of a container by replacing the ambient air in the headspace with inert gas during filling of the containers.

In particular, oxidative degradation is one of the major causes of the spoilage of sterilized packaged food product. This degradation is the result of direct contact of oxygen with the food product and reaction therebetween during extended storage of the packaged food product. The spoilage is increased at higher storage temperatures. Certain non-food products must also be protected from oxygen.

While expensive packaging can be designed to keep oxygen away from the food product, certain products must be packaged with a headspace volume for mixing and pouring. When the headspace is filled with ambient air, the headspace volume contains 21% oxygen which should be removed.

A prior art apparatus for reducing the amount of oxygen in the headspace of a gable-top container is disclosed in Nishiguchi et al. U.S. Pat. No. 4,869,047. In accordance with this teaching, a gas substitution station with a pair of inert gas-filling nozzles is arranged between the filling and top sealing stations. The first nozzle has a greater area than the second nozzle. Inert gas injected into the headspace by the first nozzle displaces the ambient air. The second nozzle is arranged to inject more inert gas into the headspace as the top fins of the carton are being brought toward each other preparatory to the top sealing step.

The arrangement of Nishiguchi et al. suffers from the disadvantage that because the outlet of the nozzle is circular and the cross section of the carton is square, the ambient air in the corners of the carton is not easily displaced. Moreover, for the foregoing reason and further because the injected inert gas initially flows radially outward and then upward along the inner wall of the carton, turbulent flow can result which serves to trap ambient air in the headspace.

Another arrangement for reducing the amount of oxygen in the headspace of a container is disclosed in Mizandjian et al U.S. Pat. No. 4,870,801. In accordance with this teaching, deoxygenation of each container is performed under inert atmosphere by means of two simultaneous injections of inert gas. The inerting device comprises an insulating cap for preventing the entry of oxygen into the packages, an inert gas feed circuit for filling the cap with inert gas and a purging gas feed circuit for flushing the packages with inert gas.

Although Mizandjian asserts that their method results in a reduction of the oxygen content to below 2%, the arrangement disclosed is disadvantageous because it requires a complex injector design.

Using conventional packaging machines running at standard form/fill/seal rates, it has been possible to reduce the amount of oxygen in the headspace from 21% to 3–6% by volume. Such conventional packaging machines employ equipment for flushing the headspace with an inert gas such as nitrogen, which is substituted for the ambient air in the carton headspace.

However, oxygen levels of 3–6% by volume in the headspace are too high to provide optimum protection against degradation for those food products requiring a shelf-life of at least one year at room temperature and under dry-shelf storage conditions. Instead a headspace oxygen level averaging less than 1% by volume is required.

DISCLOSURE OF THE INVENTION

It is an object of the invention to overcome the aforementioned disadvantages of conventional packaging machines. In particular, it is an object of the invention to provide an apparatus and a method for reducing the amount of oxygen in the headspace of a container to less than 1% by volume.

Another object of the invention is to provide a simple device for flushing the headspace of a gable-top paperboard carton with an inert gas.

Yet another object of the invention is to provide a stationary gas substitution device which provides a continuous flow of inert gas to a volume through which pass a succession of continuously moving containers.

Another object of the invention is to provide an apparatus and a method for flushing cartons to less than 1% volume oxygen without disturbing the product in the carton, adversely affecting the seal quality or bulging the carton.

A further object of the invention is to provide a method for removing oxygen from the headspace of a container wherein the container is moved continuously during flushing with inert gas.

Another object of the invention is to provide a method for removing oxygen from the headspace of a container which is relatively inexpensive and adaptable for use in-line in conventional form/fill/seal apparatus lines.

In the present invention, these objects, as well as others which will be apparent, are achieved generally by providing an inert gas dispersion device which efficiently directs inert gases into the headspace of a container moving relative thereto. This is accomplished by outputting a large volume of inert gas which blankets the headspace area of the container at low inert gas velocity, thereby displacing the ambient air in the headspace.

In accordance with the invention, the device comprises a tubular connection to a source of inert gas and a hood with a chamber which communicates with an outlet of the tubular connection. The chamber includes an aperture which is configured to overlie the headspace of a container which passes thereunder. A preferred embodiment is designed to accommodate the specifications of conventional gable-top containers which have a generally square cross-section. Accordingly, the aperture of the preferred embodiment has a rectangular cross-section, with a width in a direction transverse to the direction of movement of the container which is less than the container width measured along that same direction, and a length in the direction of container movement which is greater than the container length measured along the direction of movement.

The length in the direction of container movement of the portion of the aperture which overlies the open top of the container varies continuously from zero to the length of the container measured in that direction during a first portion of the path of the container underneath the aperture; is constant and equal to the container length during a second portion of the path of the container underneath the aperture; and varies continuously from the container length to zero during a third portion of the path of the container underneath the aperture. The width in the transverse direction of the portion of the outlet which overlies the open top is constant and equal to the width of the aperture during the second portion of the path of the container underneath the aperture.

The gas displacement device in accordance with the invention flushes the ambient aid from the headspace of a container by dispersing gaseous nitrogen or other inert gas or mixture of inert gases into the container headspace. The invention is particularly suited for use in-line a conventional form/fill/seal carton line for removing oxygen from the headspace of paperboard cartons. As set forth above, the preferred embodiment of the invention is designed for use in gable-top container applications, however, the invention is not limited to any particular container configuration. The configuration of the aperture may be modified as required to meet specifications of other carton designs.

In the preferred embodiment, gaseous nitrogen from a tank of liquid nitrogen or other source is used as the flush gas. High-velocity gas from the cylinder of liquid nitrogen is expanded to at least four times its volume to reduce its velocity and then is passed through the displacement device into the headspace of a carton moving on a conveyor belt. Gas velocity is reduced at least by a factor of 4 to a maximum velocity of about 400 to 600 feet per minute at the carton headspace. The flushing period of the preferred embodiment is approximately four seconds per carton. Empirical data shows that at least 60 times the headspace volume of a filled carton or seven times the volume of an empty carton is required to reduce the oxygen content to less than 1% by volume, although the method of the invention is not necessarily limited to these values.

On a conventional form/fill/seal line, the device is situated immediately between the top heater and sealer sections. Advantageously, the device provides an inert gas pathway for movement of cartons on the line within which carton closure is effected in the sealer section by operation of conventional apparatus such as sealer jaws. Exit areas in the device are provided for ambient air displaced in the dispersion process of the invention.

Other objects, features and advantages of the present invention will be apparent from the detailed description of the preferred embodiment of the invention which follows.

BRIEF DESCRIPTION OF THE DRAWINGS

The preferred embodiment of the invention will now be described in detail with reference to the drawings, wherein:

FIG. 2 is a bottom view of the preferred embodiment of the invention depicted in FIG. 1.

FIG. 3 is a top view of the preferred embodiment of the invention depicted in FIG. 1.

BEST MODE OF CARRYING OUT THE INVENTION

Figure 1:
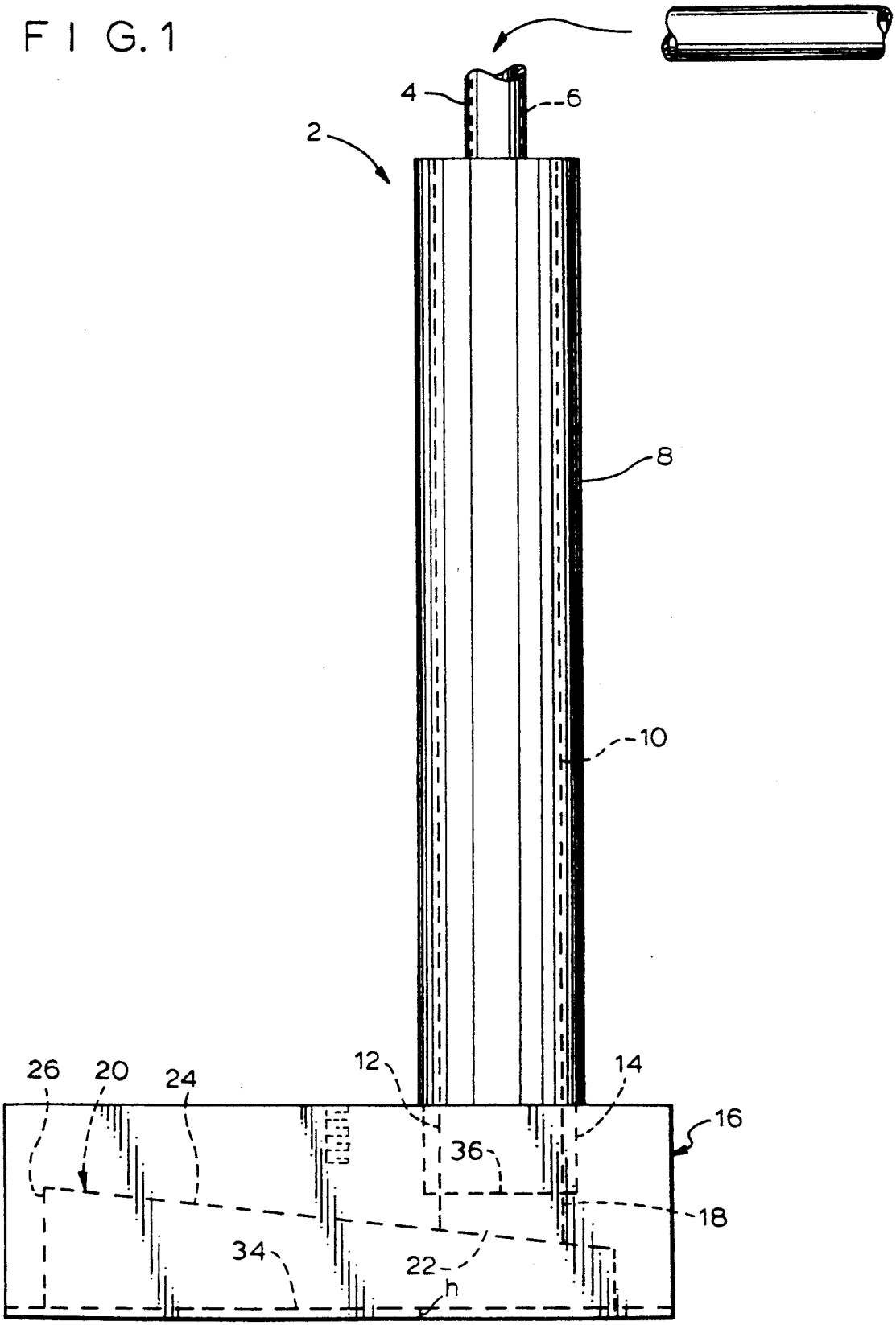
FIG. 1 is a side view of a gas displacement device in accordance with the preferred embodiment of the invention.

Referring to FIG. 1, the gas displacement device 2 in accordance with the preferred embodiment of the invention comprises tubing 4 having a cylindrical channel 6 and a pipe 8 connected to tubing 4 and having a cylindrical channel 10 which communicates with channel 6. The diameter of channel 10 is greater than the diameter of channel 6.

The pipe 8 further has an end portion 12 of reduced outer diameter which is designed to couple with a hole 14 formed in a hood 16. The outer surface of end portion 12 and the inner surface of hole 14 may be threaded for mutual engagement. Alternatively, the outer surface of end portion 12 and inner surface of hole 14 may be smooth, with corresponding diametral dimensions such that end portion 12 can be press-fitted into hole 14.

Tube 4 and pipe 8 are preferably made of stainless steel or functionally equivalent material; and hood 16 is preferably made of aluminum or stainless steel. In the preferred embodiment, tube 4 is ½"×0.035" stainless steel tubing; pipe 8 is stainless steel pipe with an internal diameter of 1"milled to 1/32"; and hood 16 has outer dimensions of 5⅝"×3 and ⅞"×1¾" when used in conjunction with half-gallon paperboard cartons. In the top view of FIG. 3, tube 6 and pipe 8 appear in section.

The hood 16 has a circular cylindrical channel 18 which communicates with channel 10 of pipe 8 via an opening 36 when the end of pipe 8 is mounted in hole 14. Hood 16 also has a chamber 20 which communicates with channel 18 via an elliptical opening 22. Chamber 20 is formed by an inclined planar top wall 24 and a peripheral wall 26, thereby forming a recess. As is best shown in FIG. 1, the height of chamber 20 varies linearly in a lengthwise direction. Peripheral wall 26 has a substantially rectangular cross section with rounded corners and forms an aperture 28 of the same shape. See FIG. 2. Aperture 28 communicates with opening 22 via chamber 20. A blanket of inert gas passes through aperture 28, as discussed in more detail below.

Conventional gable-top half-gallon paperboard cartons have a square cross section and a side dimension of 3¾". Accordingly, the dimensions of the hood are generally dictated by the need to conform to the dimensions of the cartons. For example, in the preferred embodiment of the device for use with standard half-gallon gable-top paperboard cartons, the front wall of chamber 26 has a height of 25/32"; the tear wall of chamber 26 has a height of 15/32"; and aperture 28 has a width of 2⅞" and a length of 425/32". However, the dimensions of the hood may vary in dependence on the size of the carton.

Figure 5:
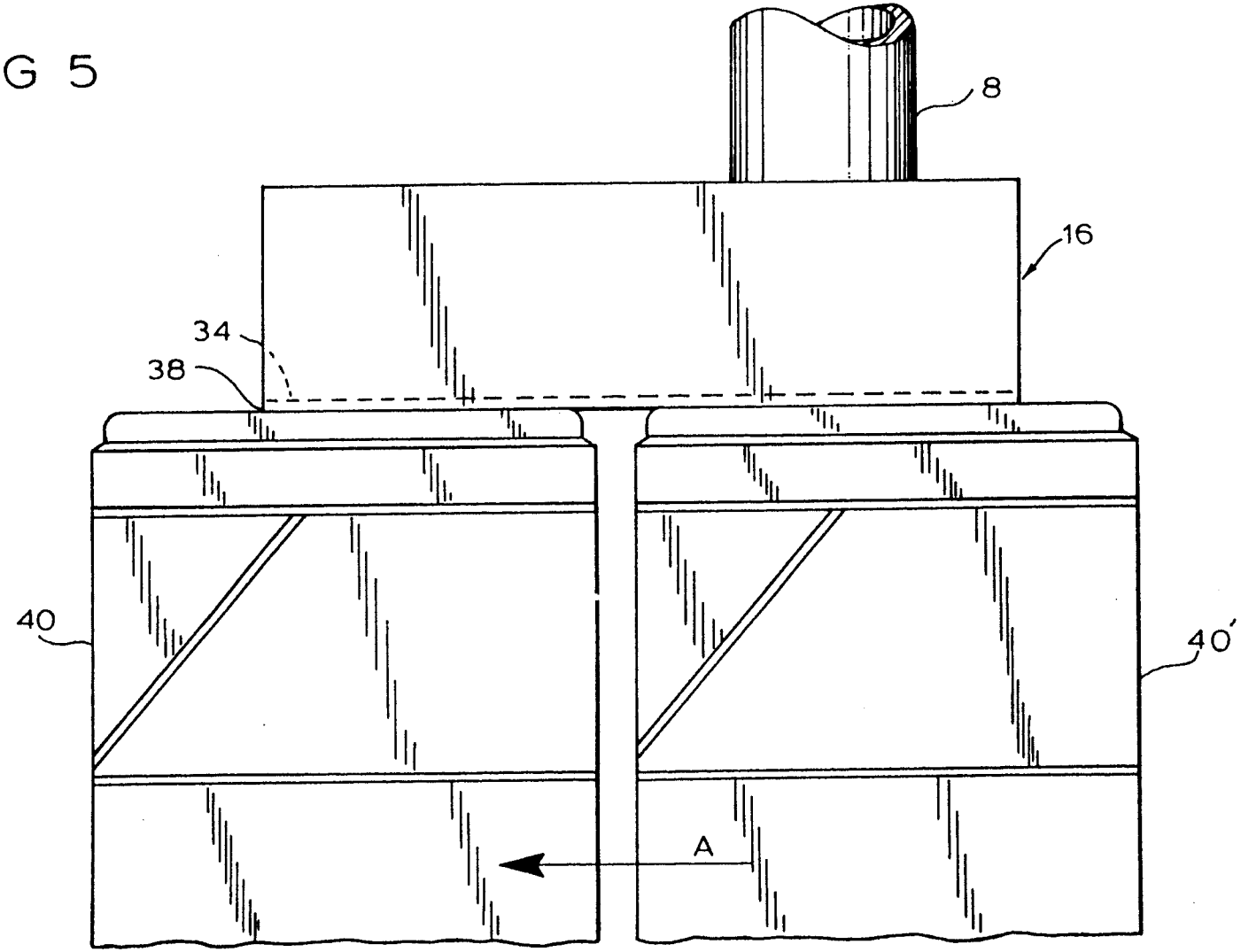
FIG. 5 is a side view of the preferred embodiment of the invention showing the position of the device relative to the moving cartons passing thereunder.

As best seen in FIG. 5, containers 40 and 40' are conveyed under the hood 16 in a lengthwise direction (denoted by arrow A) by a conveyor belt (not shown). In accordance with the preferred embodiment of the invention described herein, those containers have a square cross-section. The hood is arranged at a height such that aperture 28 is separated from the open tops of the containers thereunder by a predetermined gap denoted by the letter "h" in FIG. 1. In the preferred embodiment, which has application for use in processing standard half-gallon gable-top paperboard cartons, "h" equals 3/32".

Figure 4:
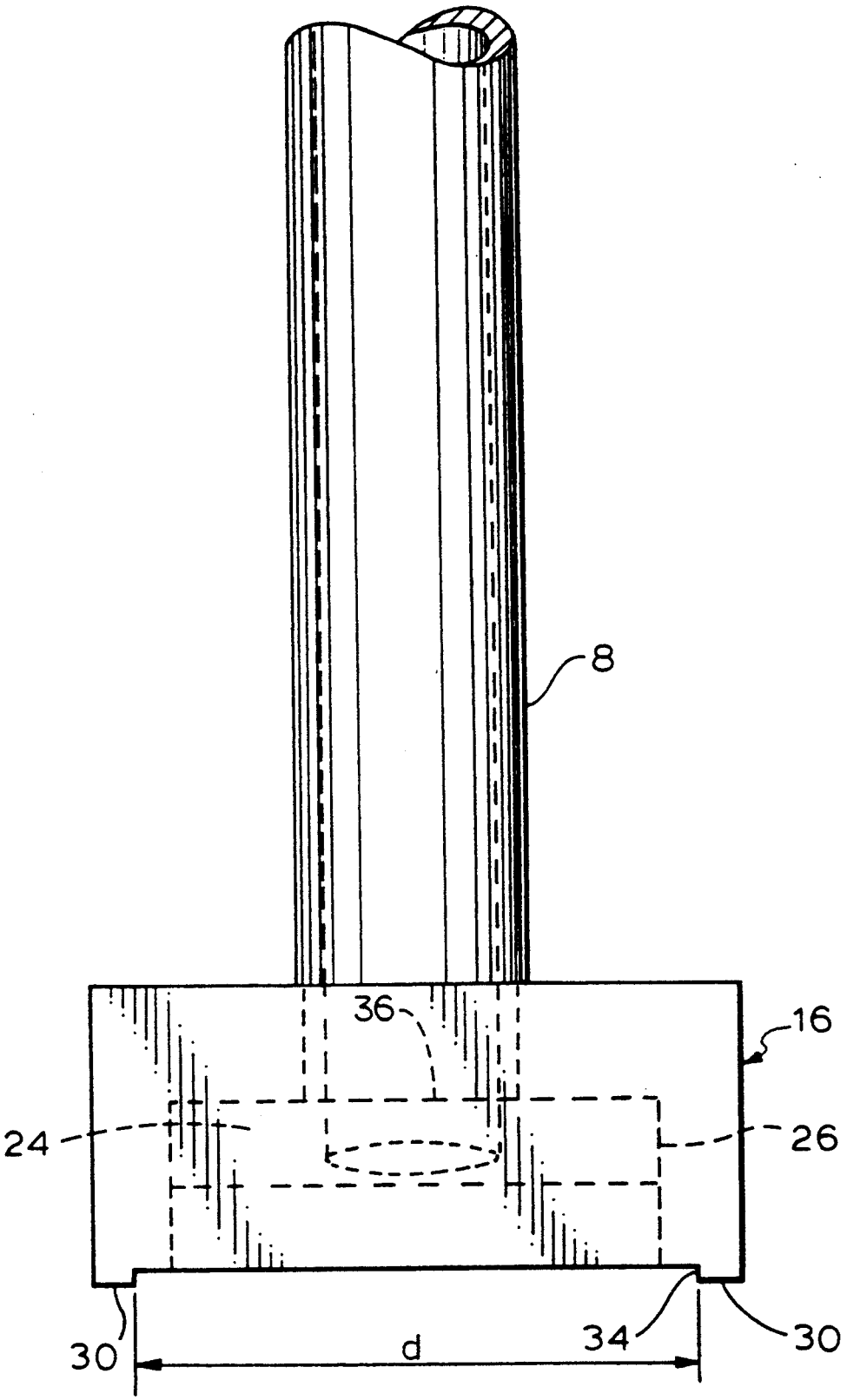
FIG. 4 is an end view of the preferred embodiment of the invention depicted in FIG. 1.

Aperture 28 is flanked on both sides by a pair of mutually parallel longitudinal protrusions 30, which form the bottommost portions of hood 16 (see FIG. 2). Protrusions 30 form of linear bars which are an integral part of the hood. Each protrusion has a planar bottom surface 32 and a planar inner side surface 34 of height "h". The bottom surfaces 32 are arranged such that opposing longitudinal side edges of the open tops of the containers 40 and 40' oppose the respective surfaces and slide thereunder with a minimum space 38 therebetween (see FIG. 5). In the preferred embodiment, the bottom surfaces have a width of ¼" and a length of 5⅝" and are separated by a distance "d" equal to 3⅜" (see FIG. 4). Thus, the inner edges of the bottom surfaces 34 are separated by a distance of 3⅜", whereas the outer edges are separated by a distance of 3⅞". Since the side dimension of a standard half-gallon gable-top paperboard carton of square cross section is 3¾", cartons on the line are positioned such that the top edges of each carton are aligned in the direction of carton movement and lie directly under the opposing bottom surface 34.

The other pair of opposing top edges of the open carton positioned under the hood 16 extend from one bottom surface 34 to the other and are separated from the planar bottom surface 36, which surrounds aperture 28, by the predetermined gap "h". These top edges cooperate with the leading and trailing portions of bottom surface 36 of hood 16 to form exit slits of rectangular shape and having dimensions h×d, that is, 3/32" by 3⅜", for the escape of ambient air displaced by the nitrogen gas which is flushed into the headspace.

Further, in accordance with the preferred embodiment disclosed herein, the front edge of aperture 28 is separated from the front edge of bottom surface 36 by a distance of ⅜"; the back edge of aperture 28 is separated from the back edge of bottom surface 36 by a distance of 15/32"; and the side edges of aperture 28 are separated from the respective protrusions 30, 36 by a distance of ¼". Also circular cylindrical channel 18 has a diameter of 1" and is equidistant from the longitudinal sides of the hood and is separated from the rear end of the hood by a distance of 1".

The device of the invention is particularly suited for use in-line on a conventional form/fill/seal carton line, situated at a station between a top heater and sealer sections. In accordance with the invention, a blanket of inert gas, preferably nitrogen, blankets the headspace of each carton which passes thereunder. A tunnel of inert gas continues to blanket each carton as it advances into and is sealed by operation of sealer jaws or other conventional apparatus in the sealer section. As the moving conveyor belt conveys each carton under the hood, an increasing area of the aperture 28 overlies the open top of the carton. The length in the direction of carton movement of the portion of the aperture which overlies the open top varies continuously from zero to 3¾", i.e., the full length of the open top of a standard half-gallon gable-top paperboard carton; is equal to 3¾" during the next 11/32" of carton travel; and varies continuously from 3¾" to zero thereafter. Thus, the blanket of inert gas is effectively swept across the open top of the carton, starting with the leading edge of the carton. The nitrogen gas flushed into the headspace of the carton displaces the ambient air therein, thereby reducing the oxygen content of the headspace to levels of less than 1%.

Figure 6:
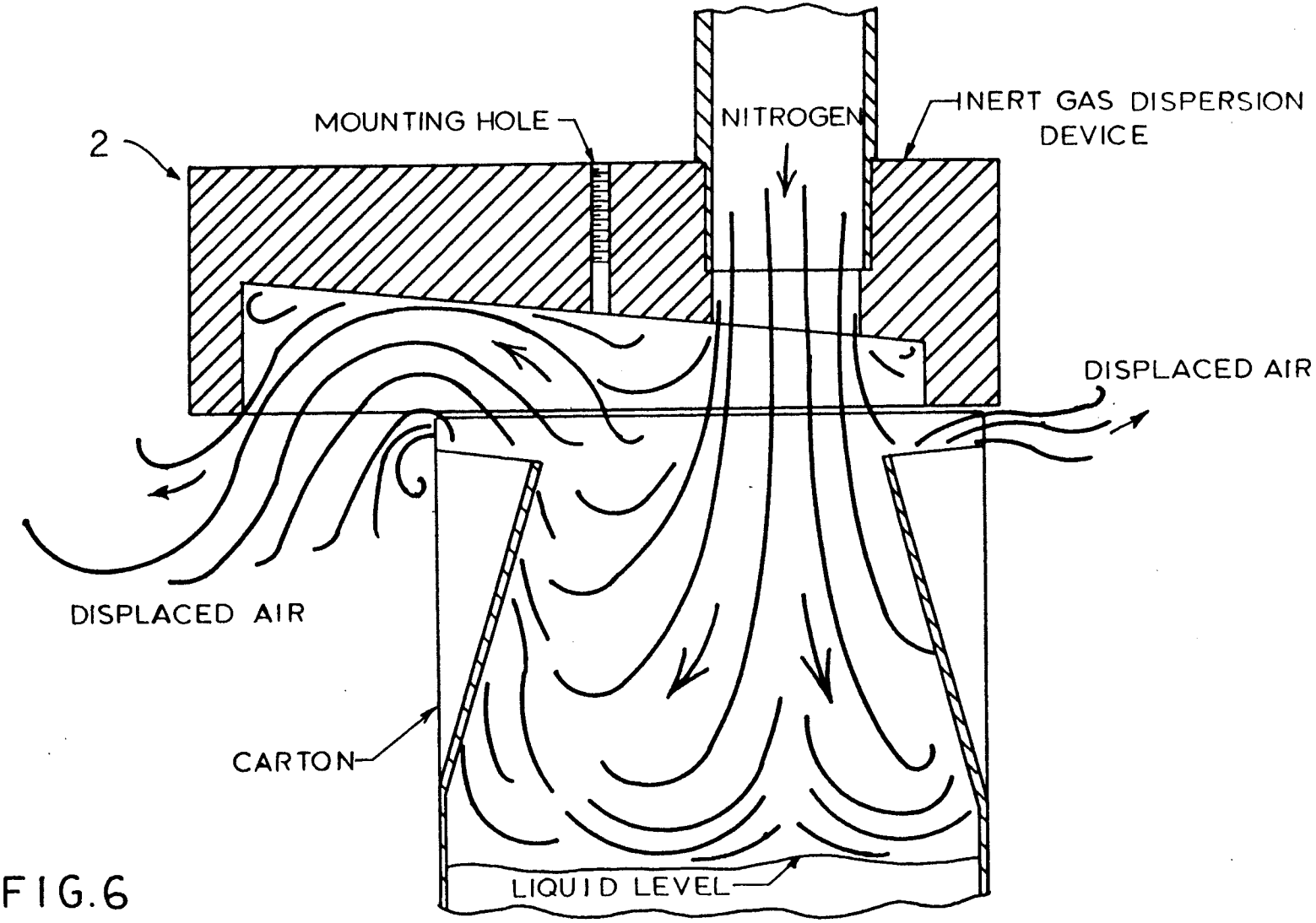
FIG. 6 is a theoretical illustration of ambient air and inert gas flow pattern obtained in operation of gas displacement device of the invention.

FIG. 6 is a theoretical illustration of ambient air and inert gas flow pattern obtained in operation of gas displacement device. It is believed that advantage in the invention is obtained by provision of high volume and low velocity inert gas flow currents which blanket the carton headspace. As illustrated in FIG. 6, the gas displacement device produces a laminar and non-turbulent flow of inert gas within the carton headspace area. Ambient air in the carton headspace is gradually displaced through the corners and sides of the carton. Laminar flow of the dispersing gas limits back currents or mixing of ambient air into the carton to obtain the oxygen dispersal efficiencies of the invention.

It will be recognized by those skilled in the art, that process line parameters for applications of the dispersal device are a function of carton volume and line speed which must be adjusted to accommodate particular line applications of the invention. In the preferred embodiment, high-velocity gaseous nitrogen is expanded to at least four times its volume to reduce its velocity and then passed to the displacement device. Gas velocity is reduced at least by a factor of 4 to a maximum velocity of about 400 to 600 feet per minute at the carton headspace. At these preferred line parameters the flushing period for each carton is approximately four seconds. Empirical data show that at least 60 times the headspace volume of a filled carton or seven times the volume of an empty carton is required to reduce the oxygen content to less than 1% by volume. The foregoing process parameters are representative of a preferred process application of the dispersion device; the invention method is not limited to these values.

From the foregoing, it will be recognized that the numerous modifications in the practice of the invention are possible in light of the above disclosure. For example, although the preferred embodiment employs gaseous nitrogen or other inert gas, mixtures of such gases may be employed in the invention. Similarly, mixtures of inert gas, oxygen and other gaseous substances may be introduced into product packaging employing the dispersion device of the invention. Thus, while principal objective of the invention is to disperse oxygen from headspace in carton headspace areas, the displacement device may also be employed as a mechanism for controlled dispersal and/or injection of oxygen or other gases into cartons to prescribed levels.

Therefore, although the invention has been described with reference to certain preferred embodiments, it will be appreciated that other composite structures and processes for their fabrication may be devised, which are nevertheless within the scope and spirit of the invention as defined in the claims appended hereto.

We claim:

1. A gas displacement device for substituting inert gas for ambient air in the headspace of a container prior to closing an opening in the top of said container, comprising:

a hood (16) having a passageway (18) with first and second openings (36 and 22) at respective open ends thereof, said passageway being a circular cylindrical section, and further having a recess (20) which communicates with said passageway via said second opening (22), said recess having a peripheral edge (28) which is a closed contour lying in a horizontal plane, said peripheral edge of said recess defining a third opening (28) in said hood;

means (8) for supplying a pressurized stream of inert gas to said first opening, said pressurized gas undergoing expansion as it passes through said second opening (22); and means for linearly displacing said container in a predetermined horizontal direction from a first position to a second position such that inert gas exciting said second opening is injected into said headspace when said container is at said first position and is not injected into said headspace when said container is at said second position, at least some portion of said recess overlying at least some portion of said container opening at said first and second positions and every position therebetween, wherein said third opening (28) has a maximum length in said direction of displacement which is greater than the maximum dimension of said container opening in said direction of displacement, and whereby when said container is in said first position, said recess (20) acts as a tunnel through which a blanket of gases flows in a downstream direction which is generally parallel to said direction of container displacement, said downstream flowing gases overlying said headspace when said container is displaced to said second position, wherein said recess is defined in part by a planar upper wall which is inclined relative to a horizontal plane and which is co-planar with said second opening, the height of said inclined upper wall increasing linearly in said direction of displacement, and is defined in part by a substantially cylindrical side wall terminating at said peripheral edge which forms said third opening, said side wall comprising first and second straight portions disposed substantially vertical and substantially parallel to said direction of displacement, said first and second straight portions being separated by a distance which is less than the maximum dimension of said container opening in a direction transverse to said direction of displacement.

2. The gas displacement device as defined in claim 1, wherein said third opening of said hood has the shape of a rectangle with rounded corners.

3. The gas displacement device as defined in claim 1, wherein said passageway is circular cylindrical in shape.

4. The gas displacement device as defined in claim 1, wherein said container comprises a gable-top paperboard carton.

5. The gas displacement device as defined in claim 1, wherein said inert gas is nitrogen.

6. The gas displacement device as defined in claim 1, wherein said hood comprises first and second rails flanking said third opening and substantially aligned in said direction of displacement such that said first and second rails oppose respective side edges of said container opening to form respective minimal gaps therebetween, whereby the flow of air displaced from said container through said gaps is minimized.

* * * * *